US005442885A

United States Patent [19]

Laven et al.

[11] Patent Number: 5,442,885

[45] Date of Patent: Aug. 22, 1995

[54] PRE-ASSEMBLY ATTACHMENT SYSTEM FOR A BOX-SECTION FRAME MEMBER AND METHOD OF ASSEMBLING

[75] Inventors: James R. Laven, Moskego; Roger B. Hooper, Iron Ridge, both of Wis.

[73] Assignee: A. O. Smith Corporation, Milwaukee, Wis.

[21] Appl. No.: 228,537

[22] Filed: Apr. 15, 1994

[51] Int. Cl.[6] ..... E04C 1/00; E04C 1/39

[52] U.S. Cl. ..... 52/731.3; 52/732.2; 29/453; 29/897.31

[58] Field of Search ..... 52/730.4, 730.5, 731.2, 52/731.3, 732.1, 732.2, 241, 243, 656.1, 656.2, 656.6; 403/384, 393; 29/453, 897.31

[56] References Cited

U.S. PATENT DOCUMENTS

| | | | |
|---|---|---|---|
| 1,867,329 | 7/1932 | Ryan | 52/241 |
| 2,254,558 | 9/1941 | Williams | 403/384 X |
| 3,420,032 | 1/1969 | Felt | 52/732.2 |
| 3,928,950 | 12/1975 | Beynon | 403/393 X |
| 5,325,651 | 7/1994 | Meyer et al. | 52/243 X |

FOREIGN PATENT DOCUMENTS

| | | | |
|---|---|---|---|
| 462070 | 3/1937 | United Kingdom | 52/731.2 |
| 618642 | of 1949 | United Kingdom | 52/731.2 |

*Primary Examiner*—Carl D. Friedman
*Assistant Examiner*—Yvonne Horton-Richardson
*Attorney, Agent, or Firm*—David R. Price; James Earl Lowe, Jr.

[57] ABSTRACT

A box section frame member includes an upper channel-shaped member having the flanges partially telescoped into the flanges of a lower channel-shaped mender. A weld connection is made at the upper edge of the lower channel-shaped member. The flanges of the lower channel-shaped member are formed with integral struck out T-shaped tabs which project inwardly and are longitudinally spaced. The upper channel-shaped member is provided with correspondingly spaced T-shaped openings located to mate with the tabs in the assembled relation. The tabs and opening are made during the formation of the channel members which are pre-assembled by press fitting of channel-shaped members with the flanges and web portions thereof deflecting to permit the movement of the openings past and into locking engagement with the tabs.

11 Claims, 2 Drawing Sheets

18
32
20
28
100
2
12
3
16
4
1
24

28
12
32
20
24
28
16
18
3
18
36
5
2
5
1
32
36
6
4
1
6
7

5
56
6
28
6
60
4
4

20
3
48
56

5
104
60
56
20
3

52
5
72
28

64
64
20
3
48
48
56

PRE-ASSEMBLY ATTACHMENT SYSTEM FOR A BOX-SECTION FRAME MEMBER AND METHOD OF ASSEMBLING

BACKGROUND OF THE INVENTION

This invention is directed to a locking lance tab preassembly attachment system for a box-section frame member, and more particularly, to a lance tab and complementary recess which is preferably a temporary connection between two channel members which are preassembled, transported and then welded together permanently to form a box-section frame member.

This invention is an improvement of the subject matter of Felt U.S. Pat. No. 3,420,032. In the Felt Patent, the lance and hole sizes are designed for a suitable clearance in all directions so that the assembly locks together loosely. This feature allowed the welding fixtures to shift and hold the parts in correct (or compensated) dimensional relationship in any of a plurality of welding fixtures for final welding.

SUMMARY OF THE INVENTION

This feature of the Felt Patent construction also permitted, however, the undesirable passing of one channel member within the other, and required the use of dimensionally controlled welding fixtures. There was no dimensional control of the depth of the box section of the pre-assembly. In addition, the various clearances between the tabs and the holes permitted undesirable longitudinal shifting of the channels relative to one another.

The invention provides a means for fixedly holding the elements together while being transported to the welding fixture from a pre-assembly station. The locking lance pre-assembly technique of the invention eliminates the above problems, without any additional expense. The forming of the locking lances and the complementary recesses is done during the conventional steps of forming and piercing the two complementary channel members, so that no additional forming seeps are required. No additional metal is required for the locking lances, or for the recesses when the lance tabs and the recesses are placed at non-critical areas of their respective flanges. The invention provides a simple and reliable means for pre-assembling a box-section frame element to facilitate transporting to the welding fixture, and loading into the welding fixture for welding.

More particularly, the invention comprises a metal box-section comprising a pair of channel members each having a pair of longitudinally extending flanges joined by a web. The metal box-section also includes a plurality of T-shaped openings disposed in the flanges of one of the channel members, with each opening being disposed between the longitudinal edge of the respective flange and the web, each opening being spaced a predetermined distance from the adjacent flange edge. The metal box-section also includes a plurality of complementary T-shaped tabs integrally lanced in the other of the channel members between the longitudinal edge of the respective flange and the web and spaced a predetermined distance from the corresponding flange edge, the tabs each being adapted to be press-fit into the associated opening, whereby the pair of channel members are locked together to define a metal box section. Each of the T-shaped tabs is integrally connected at all three ends of the T to its flange, and each T-shaped tab has two parallel edges which are generally perpendicular to another two parallel edges, with each of the T-shaped tab edges being closely adjacent a flange portion defining part of its associated opening, so as to prevent horizontal and vertical movement of the channel members relative to each other.

Other features and advantages of the invention will become apparent to those skilled in the art upon review of the following detailed description, claims and drawings.

Figure 2:
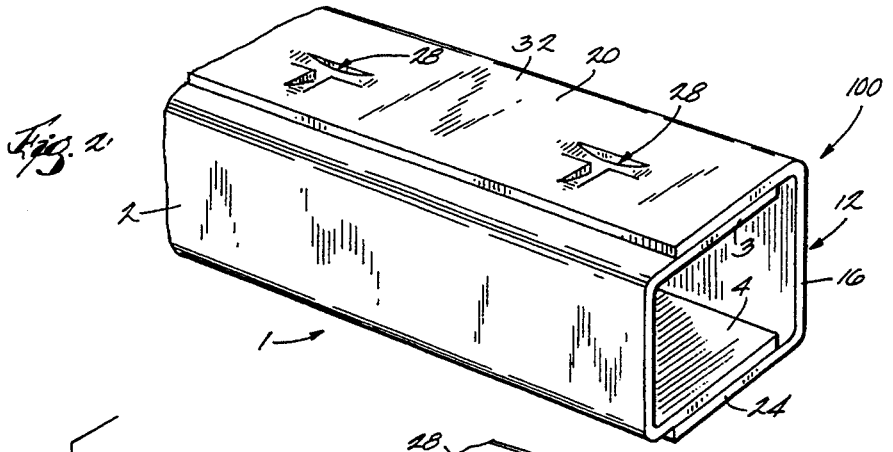
FIG. 2 is a perspective view showing the pre-assembled box-section held together by the locking lances.
Figure 1:
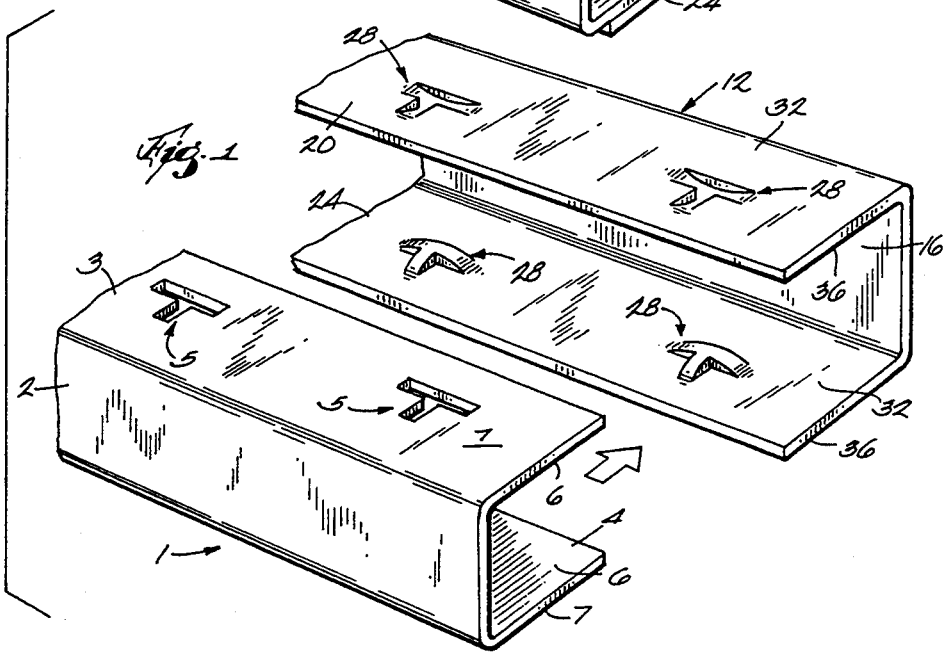
FIG. 1 is a perspective view of a pair of complementary channel members showing the locking lances and complementary recesses prior to the pre-assembly step.
Figure 3:
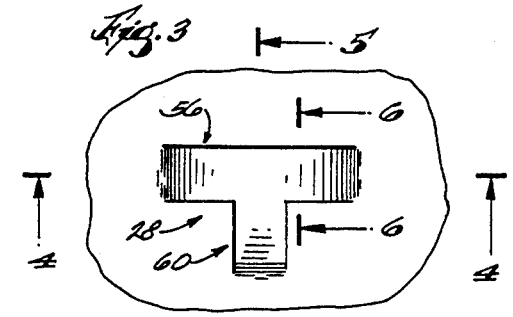
FIG. 3 is a partial top plan view of the assembled box section.
Figure 4:
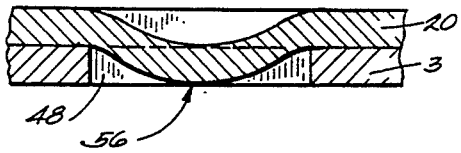
FIG. 4 is a view taken along line 4—4 of FIG. 3 through the locked lance.

Before one embodiment of the invention is explained in detail, it is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

DETAILED DESCRIPTION OF THE PREFERRED EMBODIMENT

As shown in the drawings, a first male (or inner) C-shaped or channel member 1 having a web 2 and a pair of flanges 3 and 4 is formed having a plurality of integral T-shaped recesses or openings 5 disposed at intervals throughout its length on the respective flanges 3 and 4. Each of the flanges 3 and 4 has an inner surface 6 and an outer surface 7. A second, complementary female (or outer) channel member 12, having a web 16 and a pair of flanges 20 and 24 is provided with a plurality of T-shaped lances or projections or tabs 28 which are disposed along the flanges 20 and 24, and are adapted to mate with the respective complementary openings 5. Each of the flanges 20 and 24 has an inner surface 32 and an outer surface 36.

Each of the openings 5 includes a cross leg 40 generally parallel to the web 2 and a central leg 44 extending generally perpendicular to the cross leg 40 and toward the web 2. The cross leg 40 has opposite inner locking surfaces 48 generally perpendicular to the flange inner surface 6 and generally parallel to the web 2, and the central leg 44 has opposite inner locking surfaces 52 generally perpendicular to the flange inner surface 6 and generally perpendicular to the web 2.

Each of the tabs 28 has a cross leg 56 generally parallel to the web 16 and a central leg 60 extending generally perpendicular to the cross leg 56 and away from the web 16. The cross leg 56 has opposite outer locking surfaces 64 generally perpendicular to the flange inner surface 32 and generally parallel to the web 16, and the central leg 60 has opposite outer locking surfaces 68 generally perpendicular to the flange inner surface 32 and generally perpendicular to the web 16. The central leg 60 also includes a ramp surface 72 extending inwardly from the flange inner surface 32 and toward the cross leg 56, i.e. toward the web 16.

Figure 5:
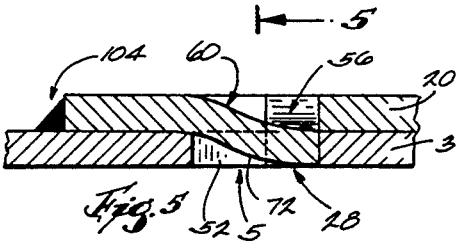
FIG. 5 is a view taken along line 5—5 of FIG. 3 through the locked lance and showing the permanent weld.
Figure 6:
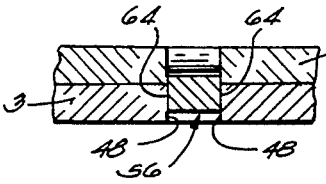
FIG. 6 is a view taken along line 6—6 of FIG. 3 through the locked lance.
Figure 7:
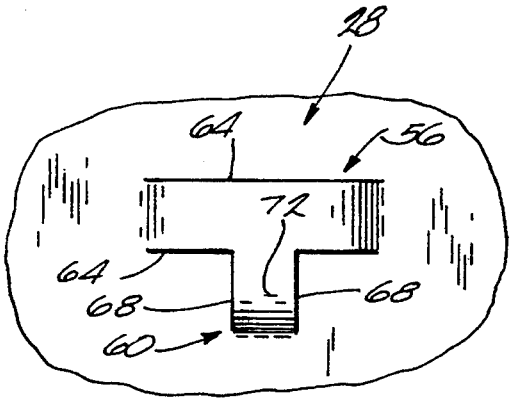
FIG. 7 is a plan view of a tab.
Figure 8:
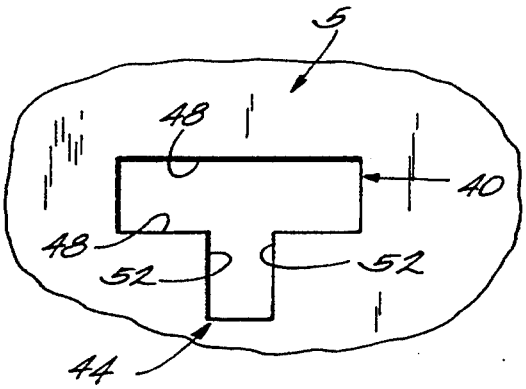
FIG. 8 is a plan view of an opening.

As shown in FIG. 2, the channel members 1 and 12 are pressed together to cause the tabs 28 to lock in the associated openings 5 to define a pre-assembled box section member 100. When the members 1 and 12 are pressed together, the flanges 3 and 4 move along the ramp surfaces 72 until the tabs 28 snap into the associated openings 5. Deflections in flanges 3, 4, 20 and 24 and in webs 2 and 16 accommodate the tab interference fit during pressing and spring back, plus tab design prevents disassembly after completion of the assembly and engagement of tabs 28 and openings 5. It can readily be appreciated that the pre-assembled box member 100 can be transported without welding or any other additional fastening to any appropriate welding fixture available for application of a permanent final weld 104 (FIG. 5), which can be applied in any suitable manner. The presently preferred means for applying weld 104 is by depositing a continuous consumable electrode along the edge of flanges 20 and 24 where they overlap flanges 3 and 4.

Each of the T-shaped tabs 28 is integrally connected at all three ends of the T to its flange, and each T-shaped tab 28 has two parallel edges (the outer surfaces 64) which are generally perpendicular to another two parallel edges (the outer surfaces 68), with each of the T-shaped tab edges being closely adjacent a flange portion defining part of its associated opening 5, so as to prevent horizontal and vertical movement of the channel members 1 and 12 relative to each other. In other words, when a tab 28 is seated in the associated opening 5, the inner locking surfaces 48 and 52 of the member 1 engage the outer locking surfaces 64 and 68 of the member 12 to prevent relative movement of the menders 1 and 12.

By virtue of the T-shaped tabs 28 and openings 5, the preassembled box-section member 100 has fixed, predetermined external dimensions, thereby establishing a precise dimensional relationship for welding.

Various features of the invention are set forth in the following claims.

What is claimed is:

1. A metal box-section comprising: a pair of channel members each having a pair of longitudinally extending flanges joined by a web, a plurality of T-shaped openings disposed in the flanges of one of said channel members, with each opening being disposed between the longitudinal edge of the respective flange and the web, each opening being spaced a predetermined distance from the adjacent flange edge, and a plurality of complementary T-shaped tabs integrally lanced in the other of said channel members between the longitudinal edge of the respective flange and the web and spaced a predetermined distance from the corresponding flange edge, said tabs each being adapted to be press-fit into an associated opening, whereby said pair of channel members are locked together to define a metal box section, and said T-shaped tabs each having three ends and being integrally connected at all three ends to the associated flange, and each T-shaped tab having a first pair of parallel edges and a second pair of parallel edges which are generally perpendicular to said first pair of edges, with each of said T-shaped tab edges being closely adjacent a flange portion defining part of the associated opening, so as to prevent horizontal and vertical movement of said channel menders relative to each other.

2. A method for assembling first and second elongated C-shaped channel members to form an elongated box-shaped structural member, each of said channel members having first and second spaced flanges connected by a web, and each of said flanges having an inner surface and an outer surface, said method comprising the steps of:

(a) forming a first recess in one of said outer surface of said first flange of said first channel member and said inner surface of said first flange of said second channel member, and a second recess in one of said outer surface of said second flange of said first channel member and said inner surface of said second flange of said second channel member;

(b) forming on the other of said outer surface of said first flange of said first channel member and said inner surface of said first flange of said second channel member a first projection extending toward said one of said outer surface of said first flange of said first channel member and said inner surface of said first flange of said second channel member, said first projection including a first ramp surface, and on the other of said outer surface of said second flange of said first channel member and said inner surface of said second flange of said second channel member a second projection extending toward said one of said outer surface of said second flange of said first channel member and said inner surface of said second flange of said second channel member, said second projection including a second ramp surface; and (c) moving said first and second channel members relative to each other with said first flange of said first channel member inward of said first flange of said second channel member and with said second flange of said first channel member inward of said second flange of said second channel member so that said webs move toward each other, one of said first flanges moves along said first ramp surface until said first projection moves into said first recess and one of said second flanges moves along said second ramp surface until said second projection moves into said second recess to substantially lock said first and second channel members together.

3. The method according to claim 2 wherein said first and second recesses are respectively formed in said outer surfaces of said first and second flanges of said first channel member; said first and second projections extend inwardly from said inner surfaces of said first and second flanges of said second channel mender; said ramp surfaces extend inwardly from said inner surfaces of said flanges of said second channel member and toward said web of said second channel member; and said first and second channel members move relative to each other with said flanges of said first channel member inward of said flanges of said second channel member so that said flanges of said first channel member each move along a corresponding ramp surface until said projections each move into an associated recess to substantially lock said first and second channel members together.

4. The method according to claim 3 wherein each of said recesses includes an inner locking surface generally perpendicular to said outer surface of said flange of said first channel member;

each of said projections includes an outer locking surface generally perpendicular to said inner surface of said flange of said second channel member, and said ramp surface progresses toward said outer locking surface; and when said projections each move into the associated recess, said inner locking surface engages said outer locking surface to prevent relative movement of said first and second channel members.

5. The method according to claim 4 wherein each of said recesses includes a plurality of inner locking surfaces generally perpendicular to said outer surface of said flange of said first channel member;

each of said projections includes a plurality of outer locking surfaces generally perpendicular to said inner surface of said flange of said second channel member, and said ramp surface progresses toward said outer locking surfaces; and when said projections each move into the associated recess, said inner locking surfaces engage said outer locking surfaces to prevent relative movement of said first and second channel members.

6. The method according to claim 3 and further including after step (c) the step of welding together said first and second channel members.

7. The method according to claim 3 wherein each of said recesses is an aperture extending through the associated flange.

8. A method for assembling first and second elongated C-shaped channel members to form an elongated box-shaped structural member, each of said channel members having a pair of spaced flanges connected by a web, and each of said flanges having an inner surface and an outer surface, said method comprising the steps of:

(a) forming a T-shaped recess in said outer surface of each of said flanges of said first channel member, said recess having a cross leg generally parallel to said web and a central leg extending generally perpendicular to said cross leg and toward said web;

(b) forming on each of said flanges of said second channel member a T-shaped projection raised inwardly from said inner surface, said projection having a cross leg generally parallel to said web and a central leg extending generally perpendicular to said cross leg and away from said web, and said central leg including a ramp surface extending inwardly from said inner surface of said flange and toward said cross leg; and (c) moving said first and second channel members relative to each other with said flanges of said first channel member inward of said flanges of said second channel member so that the respective webs move toward each other and said flanges of said first channel member each move along a corresponding ramp until said projections each move into an associated recess to substantially lock said first and second channel members together.

9. The method according to claim 8 wherein each of said recesses includes a plurality of inner locking surfaces generally perpendicular to said outer surface of said flange of said first channel member;

each of said projections includes a plurality of outer locking surfaces generally perpendicular to said inner surface of said flange of said second channel member, and said ramp surface progresses toward said outer locking surfaces; and when said projections each move into the associated recess, said inner locking surfaces engage said outer locking surfaces to prevent relative movement of said first and second channel members.

10. The method according to claim 8 and further including after step (c) the step of welding together said first and second channel members.

11. The method according to claim 8 wherein said recess is an aperture extending through said flange.

* * * * *